US006066423A

United States Patent [19]

Imafuku et al.

[11] Patent Number: 6,066,423

[45] Date of Patent: May 23, 2000

[54] TONER FOR ELECTROPHOTOGRAPHY

[75] Inventors: Tatsuo Imafuku, Nara; Toshihisa Ishida, Kashiba; Yoshinori Urata, Kashihara; Takahiro Bito, Nara; Nobuyasu Honda, Tenri, all of Japan

[73] Assignee: Sharp Kabushiki Kaisha, Osaka, Japan

[21] Appl. No.: 09/266,025

[22] Filed: Mar. 11, 1999

[30] Foreign Application Priority Data

Mar. 24, 1998 [JP] Japan ..... 10-075313

[51] Int. Cl.[7] ..... G03G 9/09

[52] U.S. Cl. ..... 430/45; 430/106; 430/109

[58] Field of Search ..... 430/106, 109, 430/110

[56] References Cited

U.S. PATENT DOCUMENTS 5,773,183 6/1998 Doujo et al. ..... 430/110

5,804,347 9/1998 Inoue et al. ..... 430/110

FOREIGN PATENT DOCUMENTS

2583754 B2 11/1996 Japan .

9-160296 6/1997 Japan .

10-239901 9/1998 Japan .

*Primary Examiner*—John Goodrow

*Attorney, Agent, or Firm*—Nixon & Venderhye P.C.

[57] ABSTRACT

A toner for electrophotography includes a binder resin as the main component and a coloring agent, wherein the binder resin contains a low molecular weight polypropylene as a separating agent, encapsulated therein; the acid value of the binder resin is adjusted equal to 1.0 (mgKOH/g) or below; and the coloring agent has a surface which is not oxidation treated and presents a pH of 7.0 or higher. Limiting the added amount and the diameter of encapsulated and dispersed polypropylene wax provides prevention against both the setoff and filming phenomena.

6 Claims, 2 Drawing Sheets

TONER FOR ELECTROPHOTOGRAPHY

BACKGROUND OF THE INVENTION (1) Field of the Invention

The present invention relates to a toner for electrophotography for visualizing the latent image formed on the image support provided for an image forming apparatus using the electrophotographic technology, such as a copier, a printer and a facsimile machine.

(2) Description of the Prior Art

In an image forming apparatus using the electrophotographic technology, such as a copier, printer, facsimile machine or the like, a static latent image is formed on the photoreceptor surface as a static latent image support. In order to visualize this latent image, the apparatus has a developing unit which supplies the developer, e.g., toner, etc., as a coloring agent, to the photoreceptor so as to make the toner adhere thereto.

The static latent image formed on the photoreceptor is developed through the aforementioned developing unit, and the thus developed, toner image is transferred to a sheet of paper as printing paper. After the transfer station, part of the toner, which could not be completely transferred, will be left over on the aforementioned photoreceptor surface. This unused, leftover toner needs to be removed from the photoreceptor surface in order to perform subsequent image forming. For this purpose, a cleaning unit for removal of the toner left over on the photoreceptor surface is provided after the transfer station. The unnecessary toner removed by the cleaning unit is collected by the collecting portion inside the cleaning unit.

Since the toner image transferred to a sheet of paper remains unfixed, it is subjected to fixing to the sheet. This fixing process usually uses heat pressing. For example, a fixing unit comprises a heat roller disposed on the side in contact with the toner image and heated at a temperature allowing for the fusion of the toner, a pressing roller which is urged by an appropriate pressing to bring the sheet with a toner image thereon into close contact with the heat roller. This heat-press type fixing unit thus configured has been widely used because of its improved heat efficiency and high fixing efficiency.

However, this fixing process provides an increased heat efficiency, but suffers from the problem of setoff in that the heat roller surface makes contact with the fusing toner and hence the toner transfers to the heat roller surface, and in turn is transferred to a next sheet. In order to eliminate this problem, a cleaner is provided to clean the heat roller surface after the fixing process. Even when this kind of cleaner is used, there are cases where the toner having stuck can not be removed completely. Also to deal with this, a means for preventing the toner from sticking to the heat roller is provided.

One example of this is the application or coating of an anti-setoff agent onto the heat roller. For example, a separation agent such as silicone oil presenting a good separation performance with respect to the toner is put over the heat roller so that the toner supported on the sheet will not adhere to the heat roller during the fixing process.

As another example, there is a preparation of toner which itself is designed not to adhere to the heat roller. For example, in the process of producing the toner, when the starting materials for the toner are mixed, a separation agent such as low molecular weight polypropylene wax etc., is added so as to be dispersed during fusing and kneading. This method prevents the toner supported by the sheet from adhering to the heat roller.

A toner having wax as a separation agent contained therein and its production method in order to prevent the setoff phenomenon are disclosed, for example, in Japanese Patent 2,583,754. This toner contains low-molecular waxes so as to provide a separation performance. This improves the anti-setoff performance. The waxes here include polyolefin, polypropylene, polyethylene etc.

As stated above, by the selection of waxes to be contained in the toner, it is possible to prevent its adherence to the heat roller, and hence this type of toner is effective in eliminating the setoff phenomenon, that is, the adherence of the toner to the heat roller etc., during fixing.

On the other hand, if a lot of wax is used in order to solve the problem of the dispersion performance of the wax and in order to provide high enough separation performance, the wax adheres to the photoreceptor upon development, causing a new problem, that is, occurrence of image defects. Specifically, if wax adheres to the photoreceptor, it cannot be removed by the cleaner, and will adhere to the photoreceptor surface in film-like forms, which will be called 'filming phenomenon'.

This phenomenon degrades the photoreceptor characteristics, causing the increase and/or decrease of the image density, fogging, and other defects, which significantly influences the image quality. This problem does not only stem from the toner, but is also considered to be attributed to the elevation of temperature within the developing unit with the development of the performance of the image forming apparatus into high speed one.

For the above reasons, a preparation of toner is needed which, without using a lot of wax, can eliminate the setoff phenomenon during fixing whilst eliminating the filming over the photoreceptor, to thereby provide stable image quality.

Further there is a concern in that deterioration of the toner or developer due to the elevation of temperature within the developing unit might degrade the image quality and fixing performance. So a toner which can also solve these problems together with the aforementioned problem has been desired.

SUMMARY OF THE INVENTION

The present invention has been devised to provide a toner which is free from the above diverse problems, and it is therefore an object of the invention to provide a toner which can prevent the occurrence of the setoff phenomenon and the occurrence of the filming phenomenon accompanied by setoff by considering, in particular, the coloring agent constituting the toner.

It is another object of the invention to provide a toner for electrophotography which can prevent the occurrence of the setoff phenomenon and the occurrence of the filming phenomenon by considering the dispersion of the wax contained in the toner.

The above objects of the invention can be attained as follows:-

When a toner is produced by having the coloring agent in the binder resin as the main component of the toner, the coloring agent has acid functional groups such as COOH, OH, CO, etc., on the surface thereof. As the number of such functional groups lowers, the toner particles present a stronger tendency toward being positively charged. One of the indicators of the amount of functional groups on the binder resin and the coloring agent is the acid value or the pH value.

As the number of the acid functional groups lowers, the acid value of the resin becomes smaller while the pH value of the coloring agent becomes greater.

When all these main components in the toner are adapted to have the same polarity, it is possible to suppress static charge irregularities of individual toner particles. In general, the static charge characteristic of the toner is determined depending on the charge control agent (CCA) as the most dominant charge carrier in the toner. When the polarity of the resin, coloring agent and other components differs from that of the CCA, the minor charge will be offset by the charge of the most dominant carrier, and the toner will have an opposite polarity charge distribution on the surface thereof. On the contrary, when the polarities of the binder resin and coloring agent are the same as that of the charge control agent (CCA) or so as not to cancel each other out to thereby prevent an opposite polarity toner. Thus, it is possible to provide a toner in which the toner particles as a whole are uniform as to static charge by eliminating the charge irregularities, producing a sharp static charge distribution. As a result, it is possible to stabilize the development and produce an excellent developed image free from fogging and density lowering.

Moreover, the stabilization of the charge characteristics prevents toner scattering and suppresses the occurrence of the filming phenomenon as well as the occurrence of the setoff phenomenon.

Further, in the toner of the present invention, a controlled amount of previous encapsulation of low molecular weight polypropylene in the binder resin of the toner of the invention promotes the prevention of filming over the photoreceptor, hence it is possible to promote suppression of image degradation due to filming; for instance, preventing density variations, fogging and other defects.

In accordance with the toner for electrophotography of the present invention, the DBP oil absorption of the coloring agent is specified so as to improve the viscoelastic characteristic, which means improvement in fixing performance and anti-setoff performance.

Further, in accordance with the toner for electrophotography of the present invention, in addition to the above configurations, the primary particle diameter of the coloring agent is specified. This factor relates to the viscoelasticity of the toner; the smaller the primary particle size, the better the anti-setoff performance. For this reason, in the present invention, the primary particle size of the coloring agent is set small so as to improve the viscoelastic characteristic, which means improvement in fixing performance and anti-setoff performance.

In accordance with the toner of the present invention, the negative factors for improving the elasticity of the binder resin are overcome by taking into account the various kinds of impurities residing in the coloring agent. Actually, the more impurities the coloring agent contains, the greater the volatile component it has. Therefore, in the present invention, the volatile component of the coloring agent is limited within a predetermined range so as to produce a toner excellent in charge characteristics and improved in elasticity, and hence, fixing performance and anti-setoff performance.

In any of the above, since an appropriate amount of wax as a separation agent is included in the toner, it is possible to promote the prevention of the setoff phenomenon, and hence prevent the filming phenomenon due to setoff.

In order to achieve the above objects, the present invention is configured as follows:

In accordance with the first aspect of the present invention, a toner for electrophotography, comprises: a binder resin as the main component, a coloring agent and a charge control agent, and is characterized in that the acid value of the binder resin is adjusted equal to 1.0 (mgKOH/g) or below, and the coloring agent has a surface which is not oxidation treated and presents a pH of 7.0 or higher.

In accordance with the second aspect of the present invention, the toner for electrophotography having the above first feature is characterized in that a low molecular weight polypropylene wax is encapsulated in the binder resin and the low molecular weight polypropylene wax is included 0.5 part to 5 parts by weight for 100 parts by weight of the binder resin.

In accordance with the third aspect of the present invention, the toner for electrophotography having the above first feature is characterized in that the molecular weight distribution of the binder resin is specified so that the number average molecular weight Mn of the high polymer component of the binder resin falls within the range of $1.0\times10^5 \leqq Mn \leqq 2.5\times10^5$ and the number average molecular weight Mn of the low molecular weight component falls within the range of $2.0\times10^3 \leqq Mn \leqq 3.2\times10^3$.

In accordance with the fourth aspect of the present invention, the toner for electrophotography having the above first feature is characterized in that the DBP oil absorption of the coloring agent is 90 (ml/100 g) or more.

In accordance with the fifth aspect of the present invention, the toner for electrophotography having the above first feature is characterized in that the primary particle diameter of the coloring agent is smaller than 30 (nm).

In accordance with the sixth aspect of the present invention, the toner for electrophotography having the above first feature is characterized in that the volatile component of the coloring agent is equal to 2.0(%) or below.

DESCRIPTION OF THE PREFERRED EMBODIMENTS

The essential requirements of the present invention to attain the above objects will become more apparent from the following description of the embodiments of the invention with specific examples.

Now, the mode of the implementation of the present invention will be described in detail. First, the developing unit equipped in the image forming apparatus which uses the toner of the present invention will be described with reference to FIG. 1.

Figure 1:
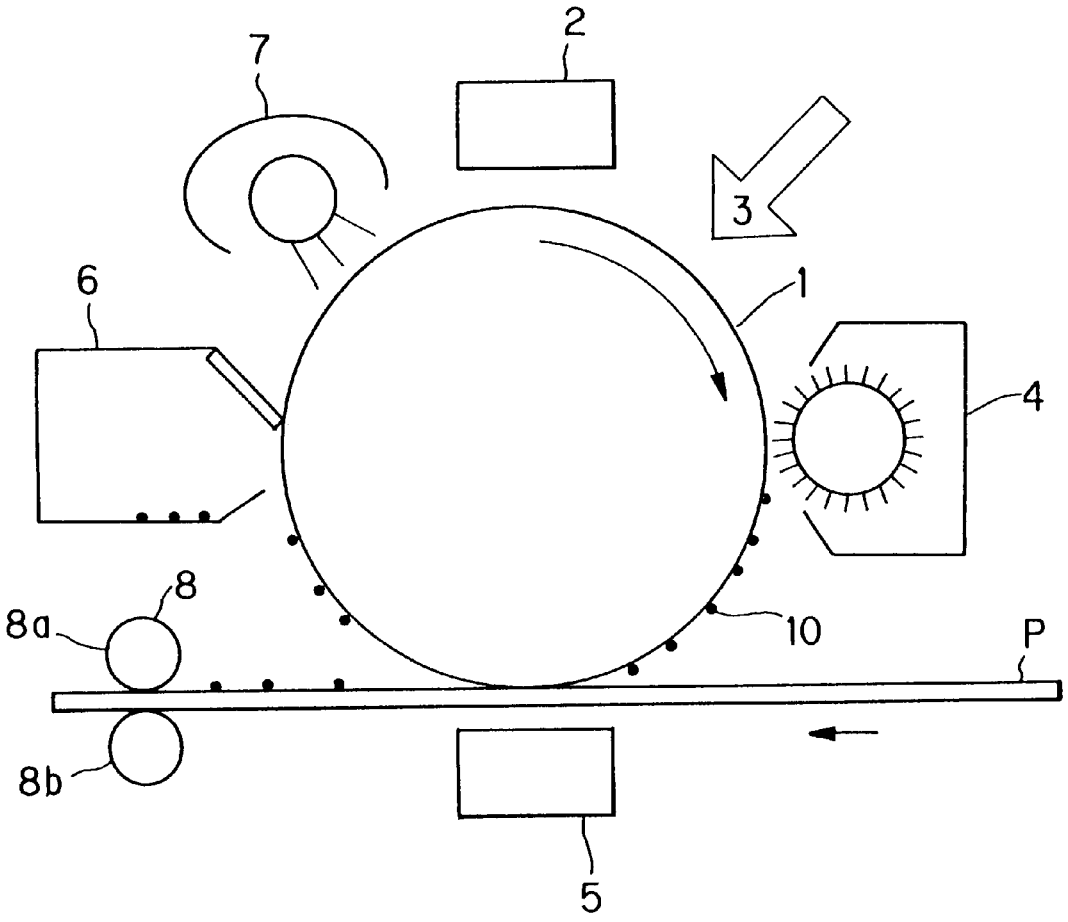
FIG. 1 is a constructional view showing an configurational example of an image forming apparatus using the toner of the present invention.

In FIG. 1, the image forming apparatus has a drum-shaped photoreceptor 1 as the image support disposed in the approximate center thereof. This photoreceptor is driven so as to be rotated at a constant speed in the direction indicated by the arrow. The image forming apparatus further includes a plurality of process elements arranged around the photoreceptor to effect image forming. These image forming process elements include: a charger 2 for uniformly charging the photoreceptor 1 surface; an optical image which is obtained from an unillustrated original image by an optical system for exposing the photoreceptor to the optical image; a developing unit 4, which relates to the present invention, for visualizing the static latent image formed on the surface of photoreceptor 1 by illuminating the optical image from the optical system; a transfer/separation charging device 5 for transferring the developed image (toner image) onto a sheet of paper or printing medium which is conveyed as appropriate and for separating the sheet after transfer from photoreceptor 1; a cleaning device 6 for removing the leftover developer (toner) which has not been transferred after transfer and remains on the surface of photoreceptor 1; and a charge erasing device 7 for erasing the charge remaining on the surface of photoreceptor 1. These elements are arranged in this order in the rotational direction of photoreceptor 1.

A plenty of sheets of paper P are stacked in, for example, a tray or cassette, although this is not shown, and are fed one by one by a paper feeding means from the stack of paper. The thus fed sheet is delivered into the transfer area between transfer device 5 and photoreceptor 1 so that the leading edge of the paper will correspond to that of the toner image formed on the surface of photoreceptor 1. After this transfer operation, the paper is separated from photoreceptor 1 by the separation charger and then delivered into a fixing unit 8.

The fixing unit fixes the unfixed toner image just transferred on the paper, into a permanent image. The fixing unit comprises a heat roller 8*a* which is disposed so as to be in contact with toner image 10 and a pressing roller 8*b* which presses the paper into close contact with heat roller 8. This heat roller 8*a* is heated to a temperature for fusing and fixing of the toner. Paper P having passed through this fixing unit 8 is discharged from the exterior of the image forming apparatus by means of an unillustrated discharge roller.

The optical system for irradiating the surface of photoreceptor 1 with the aforementioned optical image 3, if it is of a copier, illuminates the original placed on the original table and focuses the reflected light from the original through mirrors and focusing lenses. When the image forming apparatus is a printer or facsimile machine, the aforementioned optical system includes a semiconductor laser which is controlled so as to be switched on and off in accordance with the input image data so as to irradiate the surface of photoreceptor 1 with a beam of light from the laser passing through the optical deflector etc. Thus, the optical system irradiates the surface of photoreceptor 1 with an optical image 3 directly reflected from the original or with an optical image 3 in accordance with the image data so as to form a static latent image on the surface of photoreceptor 1 which has been uniformly charged.

The static latent image thus formed on the surface of photoreceptor 1 is developed by developing unit 4 located opposite photoreceptor 1 as shown in FIG. 1. That is, toner as the developer selectively adheres to the static latent image so as to visualize it with the toner.

Figure 2:
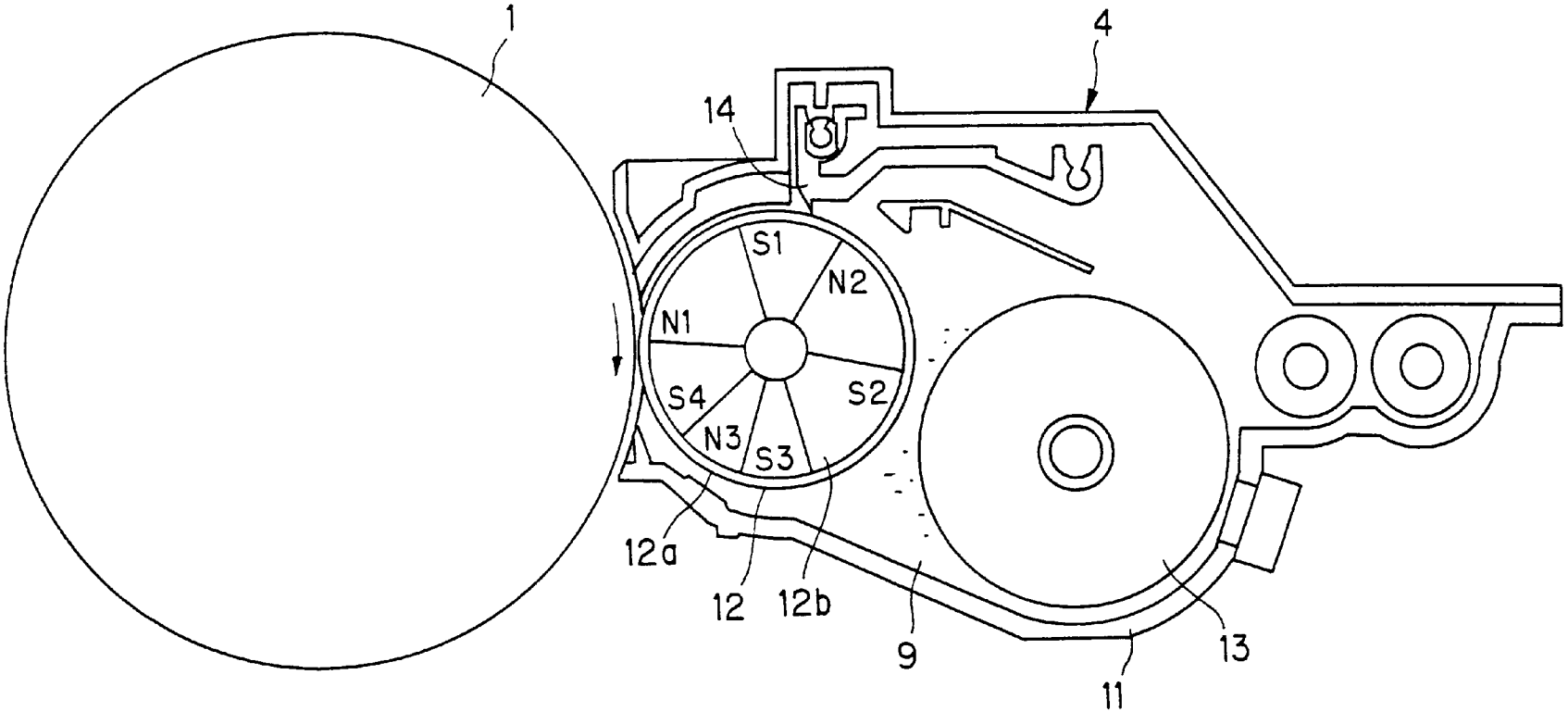
FIG. 2 is a constructional view showing the detail of the developing unit in the image forming apparatus shown in FIG. 1.

This developing unit 4, as configurationally shown in FIG. 2, has in its developing hopper 11 for storing developer 9, a developing roller 12 which is rotatably mounted inside developing hopper 11 and an agitating and conveying means 13 for conveying and/or agitating the developer, and further includes a toner supplying device disposed in the upper part of developing hopper 11 for supplying the toner as required.

Developing roller 12, if it is for a two component developer, or a single component magnetic type toner, has a magnetic roller 12*b* having a multiple number of magnetic poles inside a cylindrical non-magnetic sleeve 12*a*, and attracts the developer by the magnetic force of magnetic roller 12*b* and conveys it when sleeve 12*a* rotates in the direction indicated by the arrow, to the developing area opposing photoreceptor 1. Therefore, developer 9, whilst being attracted to the surface of sleeve 12*a* by the magnetic force of magnetic roller 12*b*, is conveyed by the rotation of sleeve 12*a* so as to be conveyed to the developing area opposing photoreceptor 1. The developer is made to stand up in a brush-like manner or in 'spikes' at the area corresponding to one of the magnetic poles in magnetic roller 12*b* opposing the developing area, the bristle-like developer wipes across the surface of photoreceptor 1, whereby the toner adheres to the static latent image formed on the surface of photoreceptor 1 to effect the development.

Concerning the aforementioned developer 9, in addition to two component developers consisting of toner particles and magnetic carriers and single component developers consisting toner particles which themselves have magnetic properties, developers consisting of non-magnetic single component toner particles are generally known.

The developer attracted to developing roller 12 is cut down before reaching the developing area by a regulating member (doctor) 14 so that the attracted amount of the toner is uniform. More specifically, the regulating member is fixed at its one end to the developing hopper 11 and the other end is positioned with the predetermined clearance (distance) apart from developing roller 12. The developer, whilst passing through the clearance defined by this regulating member, is made uniform as to its amount, whereby a thin layer of developer 9 is formed on the surface of developer roller 12, and is conveyed to the developing area.

Concerning the toner supplying device, a supplying roller for supplying the toner is provided inside the hopper for storing the toner. This supplying roller is composed of a porous material (for example, sponge), and holds the toner in the pores and supplies the toner to the supplying port formed in developing hopper 11.

Provided on the developing hopper 11 side opposing the supplying port is an agitating and conveying means 13, which agitates the supplied toner with developer 9 inside developing hopper 11 and conveys it to developing roller 12.

As stated above, concerning developer 9, other than two component developers consisting of carriers and toner particles and single component developers consisting only of toner particles, there are non-magnetic type single component developers. For a non-magnetic single component developer, since it cannot be attracted by magnetic force to the surface of developing roller 12, the toner is conveyed by using tribo-charging or the like to attract the developer to the surface of developing roller 12. The developing roller 12 in this case is often made up of an elastic material such as rubber etc. Then, regulating member 14 or the like is used to regulate the toner layer attracted to the surface of developing roller 12, so as to form a thin layer having a constant thickness.

Since developer 9 of a single component toner does not need any control of the toner concentration in the developer, no toner supplying device is needed. Therefore, the developer is supplied at a time to developing hopper 11 by means of a toner cartridge etc. On the other hand, if developer hopper 11 needs to be filled up with a certain level of the single component toner, a toner supplying device is provided into which the developer is supplied at a time from the toner cartridge, so that the toner supplying device can supply the toner as necessary.

(The embodiment of the invention)

Now, description will be made hereinbelow of toner compositions constituting developer 9, of the present invention, stored in the aforementioned developing unit 4, specifically in developing hopper 11 as well as production methods of toners.

The toner is produced by usually adding a wax in order to provide separation performance to a binder resin, further blending carbon black as a coloring agent, a charge control agent for controlling static charge and the like, and then kneading these materials, followed by crushing and classifying so as to provide toner particles having a prescribed particle size, e.g. about 10 $\mu$m. The thus obtained toner is further mixed with some additives as required to thereby provide externally additive-treated toner as the developer.

For the binder resin any of the generally known resins may be used. An example is styrene acrylic resin. Styrene acrylic resin is a copolymer composed of styrene as the main component and other vinyl monomers.

The wax component is of polyolefins having a relatively low melting point and having a weight average molecular weight of about 1,000 to 45,000, preferably about 2,000 to 10,000. Specific examples include polyethylene, polypropylene, polybutylene, etc. In accordance with the present invention, polypropylene, which is low in molecular weight, is most preferable, and other waxes stated above can be used as required.

When carbon black is used as the coloring agent, the image formed by the toner will be black. When toner of yellow, cyan, magenta or other colors needs to be prepared, a known appropriate coloring agent can be selected as required.

While a charge control agent (CCA) is added in order to permit the toner to have an appropriate static polarity and an appropriate amount of static charge, this charge control agent may be of a well-known one which is also selected as appropriate in accordance with the required polarity. For example, a quaternary ammonium salt is used in the after-mentioned examples, but this will not limit the invention, and an arbitrary known material can be selected.

As has been stated heretofore, the starting materials for toner, composed of a binder resin, a wax, a coloring agent and a charge control agent are mixed, kneaded, crushed and classified so as to obtain a toner having a prescribed particle size. When this toner is used as the developer, a fluidizing agent, e.g., silica etc., is added and mixed in order to improve the charge performance and fluidity to thereby provide a usable toner.

The above described toner is used as it is if it is to be used as a single component developer. When this toner is used for a two component developer, the externally additive-treated toner and magnetic carriers are blended to provide a developer.

For the production of a single component developer, in order to provide magnetic properties, the aforementioned starting materials for the toner are further added with a magnetic powder, e.g., magnetic iron oxide, reduced iron oxide etc., and the materials are then mixed, kneaded, crushed and classified to provide a magnetic toner having a prescribed particle size, in the same manner as above. In this magnetic toner, silica etc., is added and mixed in order to improve the fluidity.

In the present invention, in order to prevent the occurrence of the setoff phenomenon that causes the toner to adhere to fixing unit 8, especially heat roller 8*a* etc., a wax having a good separation performance with respect to heat roller 8*a* is made to be contained by the toner. Further, the amount of the wax content is correctly regulated so that the wax will not adhere to the photoreceptor or not cause filming.

The binder resin for binding, as the main component of the starting materials for the toner of the present invention, is prepared together with a polypropylene wax, having a low molecular weight, encapsulated beforehand or contained in a complex form. Here, 'encapsulation' is effected during the polymerizing stage of a resin. The polymerization means a polymerizing process used for the production of a general binder resin such as solution polymerization, emulsion polymerization, etc. Although the polymerization is not particularly limited, solution polymerization is preferred, and the binder resin used in the invention, e.g., a styrene acrylic resin, is encapsulated with polypropylene as mentioned above.

Since the thus prepared binder with a wax encapsulated beforehand, is used as a starting material for the toner, it is possible to prevent the phenomenon of filming over the surface of photoreceptor 1 and the phenomenon of setoff to heat roller 8*a* for fixing, which both become problematic in an image forming apparatus which runs at a high speed, specifically 70 sheets per minute or more (in terms of the discharge rate of sheets after image forming from the image forming apparatus).

In order to enhance the above effect, the encapsulated wax such as low molecular weight polypropylene, etc., is dispersed into the resin with its particle diameter equal to 0.5 $\mu$m or below.

Further, by setting the encapsulated content of the wax in the binder resin, at the range from 0.5 part by weight to 5 parts by weight for 100 parts by weight of the binder resin, it is possible to make the dispersed state of the wax within toner particles more uniform. In particular, when the added amount of the wax is set to fall within the range from 1 part by weight to 2 parts by weight, a further improved effect can be obtained.

On the other hand, high speed image forming apparatuses suffer from the problem in that the toner is fixed to paper P with insufficient strength. More explicitly, because of the high speed processing, paper P supporting a toner image thereon is made to pass through fixing unit 8 in a very short period of time, and hence the fixing process is finished before the toner fuses sufficiently. Resultantly, the toner cannot be fixed firmly onto the paper, so will peel off readily. Further, in this case, the toner tends to adhere to the heat roller, possibly causing the setoff phenomenon. To make matters worse, the high speed operation of developing unit 4, breaks the toner particles into pieces whilst agitating means 13 etc., agitates the toner. This not only induces the filming phenomenon but also degrades the fixing performance.

In order to obtain a toner which can eliminate the above drawbacks as well as can prevent occurrence of the above-mentioned setoff and filming phenomena, the physical properties of the binder resin, especially the fracture toughness and the viscosity are enhanced. That is, prevention of breakage of the toner due to agitation inside developing hopper 11, is effective in stabilizing the amount of static charge on the toner and hence preventing the lowering of the image density and the occurrence of fogging. Prevention of toner breaking is also effective in improving the fixing performance while enhancement of the viscosity is effective in improvement of the fixing performance.

Also for these reasons, the binder resin as the main component of the toner, is specified so that the number average molecular weight Mn of the high polymer component of the binder resin which determines the fracture strength is adapted to fall within the range of $1.0\times10^5 \leqq Mn \leqq 2.5\times10^5$ and the number average molecular weight Mn of the low molecular weight component which determines the viscosity is adapted to fall within the range of $2.0\times10^3 \leqq Mn \leqq 3.2\times10^3$. These specifications solve the above problems and prevent the degradation of the image quality, and prevent the filming and setoff phenomena occurring while the fixing performance is kept high.

The effects and advantages of the toner for electrophotography of the present invention were confirmed based on the examples shown hereinbelow. These examples also include the cases in which toners to be compared to the toner of the present invention were produced and used for image forming.

In order to confirm the effects and advantages of the toner used in the present invention, a SD-4085 copier (a product of Sharp Kabushiki Kaisha (a high-speed copier having a copy performance of eighty-five sheets per minute) was used to evaluate the toner performance based on the image density and fogging. The image density was measured using a MACBETH Densitometer (MACBETH) and fogging was measured using a Z-II OPTICAL SENSOR (NIPPON DENSHOKU INDUSTRIES CO., LTD.). Fogging is represented as the density measurement of white sections (background) in the paper.

The evaluation was made based on the judgment as to the images at the initial stage of copying, after a 100,000 (which will be written as 100K hereinbelow) copy run. The anti-filming performance, the fixing performance, the anti-aging performance, the anti-setoff performance were judged from visual observation and classified into three levels.

The styrene acrylic binder resins used in the aftermentioned examples, the encapsulated amount and domain diameter of polypropylene contained in the binder resin are listed in Table 1 below. All the binder resins shown in Table 1 are products of Sanyo Chemical Industries, Ltd. The wax used is VISCOL 660P(polypropyrene wax), a product of Sanyo Chemical Industries, Ltd.

The wax encapsulated in advance within the binder resin was low molecular weight polypropylene. Here, the domain diameter means the longest dimension of the wax dispersed within the binder resin. If two high polymer substances incompatible with each other are mixed, the two substances are segregated from each other due to the difference in boundary tension, so that the high polymer substance which is of a lower amount in the mixture will be dispersed in isolated forms or like islands within the high molecular weight substance which is of a greater amount in the mixture. This island structure is termed a domain, which is of a liquid form and has an approximately spherical shape. In the case of the present invention, the high polymer substance being of a greater amount is the resin and the one being of a lower amount is the wax. That is, the wax will be dispersed in island (domain) forms inside the resin.

The diameter was measured by dissolving the binder resin to be evaluated into tetrahydrofuran (THF), collecting the THF insoluble component using a membrane filter having a mesh diameter of 0.1 $\mu$m, and observing the filter using a SEM (S2500) of Hitachi, Ltd. The viscoelasticity was measured by a Rheometer RDS-7700 (a product of Rheometrics). The molecular weight distribution, that is, the number average molecular weight (HpMn) of the high polymer component and the number average molecular weight (LpMn) of the low molecular weight component were measured by an LC6A (SHIMADZU CORPORATION).

(EXAMPLE 1)

Loaded in a mixer (SUPER MIXER: a product of KAWATA CO., LTD.), 100 parts by weight of the binder resin shown in 'example 1' of Table 1 above, having 1.0 part by weight of the wax encapsulated therein, 10 parts by weight of carbon black (Printex 70: a product of Degussa Corporation) as a coloring agent and 1.5 parts of a quaternary ammonium salt (P-51: a product of ORIENT CHEMICAL INDUSTRY CO., LTD.) as a charge control agent, and these compounds are mixed to prepare a starting mixture for toner.

Next, the above-prepared material mixture was loaded into a biaxial kneader (PCM65: a product of IKEGAI Corporation) as a kneader. The kneading cylinder was set at 150° C. (kneading temperature) so that the mixture was fused and kneaded. Thereafter, the mixed and kneaded material was crushed and classified to so that a toner having a mean particle size of about 10.0 $\mu$m was obtained.

TABLE 1

| | Binder Resin (100 parts by weight) | | | | | | | Wax | | Carbon Black | | | | | |
|---|---|---|---|---|---|---|---|---|---|---|---|---|---|---|---|
| Example | HpMn ($\times 10^5$) | LpMn ($\times 10^3$) | G Preserv. Elasticity 1(N/cm$^2$) (° C.) | Tη Melt Viscosity 1000 Pa · s (° C.) | G' Loss Elasticity G'140° C. (N/cm$^2$) | Tg Glass-transition temp. (° C.) | Acid Value (mgKOH/g) | Encap-sulated Wax Amount (parts) | Wax Domain Diameter | Carbon | Added Amount (parts) | DBP Absorption Oil Amount | Primary Particle Diameter (nm) | Volatile Component (%) | pH |
| 1 | 1.75 | 2.6 | 186 | 122 | 3.8 | 65 | 0.5 | 1.0 | 0.3 | Degussa Printex 70 | 10 | 123 | 18 | 1.2 | 9.0 |
| 2 | 1.75 | 2.6 | 186 | 122 | 3.8 | 65 | 3.0 | 1.0 | 0.3 | Degussa Printex 70 | 10 | 123 | 18 | 1.2 | 9.0 |
| 3 | 1.75 | 2.6 | 186 | 122 | 3.8 | 65 | 0.5 | 1.0 | 0.3 | MITSUBISHI CHEMICAL MA-100S | 10 | 100 | 22 | 1.5 | 3.5 |
| 4 | 0.8 | 1.5 | 186 | 122 | 3.8 | 65 | 0.5 | 1.0 | 0.3 | Degussa Printex 70 | 10 | 123 | 18 | 1.2 | 9.0 |
| 5 | 3.0 | 3.5 | 186 | 122 | 3.8 | 65 | 0.5 | 1.0 | 0.3 | Degussa Printex 70 | 10 | 123 | 18 | 1.2 | 9.0 |
| 6 | 1.75 | 2.6 | 150 | 122 | 3.8 | 65 | 0.5 | 1.0 | 0.3 | Degussa Printex 70 | 10 | 123 | 18 | 1.2 | 9.0 |
| 7 | 1.75 | 2.6 | 220 | 122 | 3.8 | 65 | 0.5 | 1.0 | 0.3 | Degussa Printex 70 | 10 | 123 | 18 | 1.2 | 9.0 |
| 8 | 1.75 | 2.6 | 186 | 110 | 3.8 | 65 | 0.5 | 1.0 | 0.3 | Degussa Printex 70 | 10 | 123 | 18 | 1.2 | 9.0 |
| 9 | 1.75 | 2.6 | 186 | 140 | 3.8 | 65 | 0.5 | 1.0 | 0.3 | Degussa Printex 70 | 10 | 123 | 18 | 1.2 | 9.0 |
| 10 | 1.75 | 2.6 | 186 | 122 | 3.0 | 65 | 0.5 | 1.0 | 0.3 | Degussa Printex 70 | 10 | 123 | 18 | 1.2 | 9.0 |
| 11 | 1.75 | 2.6 | 186 | 122 | 5.0 | 65 | 0.5 | 1.0 | 0.3 | Degussa Printex 70 | 10 | 123 | 18 | 1.2 | 9.0 |
| 12 | 1.75 | 2.6 | 186 | 122 | 3.8 | 55 | 0.5 | 1.0 | 0.3 | Degussa Printex 70 | 10 | 123 | 18 | 1.2 | 9.0 |
| 13 | 1.75 | 2.6 | 186 | 122 | 3.8 | 75 | 0.5 | 1.0 | 0.3 | Degussa Printex 70 | 10 | 123 | 18 | 1.2 | 9.0 |
| 14 | 1.75 | 2.6 | 186 | 122 | 3.8 | 65 | 0.5 | 1.0 | 0.3 | Degussa Printex 95 | 10 | 52 | 15 | 1.0 | 9.5 |
| 15 | 1.75 | 2.6 | 186 | 122 | 3.8 | 65 | 0.5 | 1.0 | 0.3 | Degussa Printex A | 10 | 118 | 41 | 0.7 | 9.0 |
| 16 | 1.75 | 2.6 | 186 | 122 | 3.8 | 65 | 0.5 | 1.0 | 0.3 | MITSUBISHI CHEMICAL OIL 31B | 10 | 107 | 30 | 5.5 | 8.0 |
| 17 | 1.75 | 2.6 | 186 | 122 | 3.8 | 65 | 0.5 | 1.0 | 0.3 | Degussa Printex 70 | 3 | 123 | 18 | 1.2 | 9.0 |
| 18 | 1.75 | 2.6 | 186 | 122 | 3.8 | 65 | 0.5 | 1.0 | 0.3 | Degussa Printex 70 | 13 | 123 | 18 | 1.2 | 9.0 |
| 19 | 1.75 | 2.6 | 186 | 122 | 3.8 | 65 | 0.5 | 0 | 0.3 | Degussa Printex 70 | 10 | 123 | 18 | 1.2 | 9.0 |
| 20 | 1.75 | 2.6 | 186 | 122 | 3.8 | 65 | 0.5 | 6.0 | 0.3 | Degussa Printex 70 | 10 | 123 | 18 | 1.2 | 9.0 |
| 21 | 1.75 | 2.6 | 186 | 122 | 3.8 | 65 | 0.5 | 1.0 | 1.0 | Degussa Printex 70 | 10 | 123 | 18 | 1.2 | 9.0 |

Then, 100 parts by weight of the toner thus obtained from the above production process was loaded into the aforementioned mixer, and 0.1 part by weight of silica powder (R972: a product of NIPPON AEROSIL CO., LTD.) and 0.1 part by weight of magnetite powder (KBC100: a product of Kanto Denka Kogyo Co., Ltd.) were externally added thereto and mixed together, thus producing an externally additive-treated toner.

Further, 4 parts by weight of the externally additive-treated toner and 100 parts by weight of ferrite carriers made up of ferrite cores coated with a silicone resin were loaded into, a mixer, specifically, Nauta mixer (a product of Hosokawa Micron Corporation) and agitated and mixed thus producing a two component developer.

The diameter of the dispersed wax in the thus obtained toner particles, especially, the domain diameter was measured in the same manner as in the above-described measurement of the diameter of the dispersed particles within the binder resin. As a result, the diameter was 0.3 $\mu$m.

With a correct amount of the thus obtained two component developer supplied to the developing hopper, a 100 K sheet actual copy run was performed in SD-4085 copier whilst the externally additive-treated toner as the supplement toner was being supplied as required. This actual copy run was performed in a 25° C., RH 60% atmosphere.

applied to the grid of the charger in N mode, whereas −440 V is applied to the grid in P mode, to charge the photoreceptor to the respective potential. The conditions of the thus obtained image, that is, the density of the toner image and fogging are measured for evaluation.

(EXAMPLE 2)

The binder resin and coloring agent prescribed in 'example 2' in Table 1 and the charge control agent were blended under the same conditions as in example 1 to prepare a mixture of starting materials for a toner. In this example 2, a toner for electrophotography was prepared in the same manner and under the same conditions as in example 1, except that the acid value of the binder resin was set at 3.0 (mg4KOH/g).

The image after 100K copies in the same copier as in example 1 using this toner for electrophotography was evaluated and is shown in Table 2 above. The evaluation result of the toner obtained in this example 2 exhibited an allowable level of image density but a high level of fogging because the static charge distribution had a wide spread containing many toner particles having the opposite polarity.

TABLE 2

| | Image Density | | | | Fogging | | | | | | | | |
|---|---|---|---|---|---|---|---|---|---|---|---|---|---|
| | Initial Stage | | 100K | | Initial Stage | | 100K | | Anti- | | Anti- | Anti- | Preserv- |
| Example | N mode | P mode | N mode | P mode | N mode | P mode | N mode | P mode | filming | Fixing | aging | setoff | ability |
| 1 | 1.41 | 1.15 | 1.39 | 1.15 | 0.32 | 0.40 | 0.31 | 0.34 | ○ | ○ | ○ | ○ | ○ |
| 2 | 1.41 | 1.15 | 1.39 | 1.15 | 1.62 | 1.55 | 1.88 | 1.56 | ○ | ○ | ○ | ○ | ○ |
| 3 | 1.42 | 1.17 | 1.38 | 1.12 | 1.59 | 1.61 | 1.99 | 1.64 | ○ | ○ | ○ | ○ | ○ |
| 4 | 1.41 | 1.16 | 1.35 | 1.20 | 0.35 | 0.42 | 0.32 | 0.35 | X | ○ | X | X | Δ |
| 5 | 1.40 | 1.17 | 1.36 | 1.22 | 0.34 | 0.39 | 0.52 | 0.59 | ○ | X | ○ | ○ | ○ |
| 6 | 1.41 | 1.15 | 1.21 | 1.00 | 0.36 | 0.42 | 0.32 | 0.35 | X | ○ | X | X | Δ |
| 7 | 1.40 | 1.12 | 1.38 | 1.14 | 0.39 | 0.48 | 0.38 | 0.46 | ○ | X | ○ | ○ | ○ |
| 8 | 1.43 | 1.14 | 1.42 | 1.11 | 0.45 | 0.55 | 0.39 | 0.41 | Δ | ○ | Δ | X | Δ |
| 9 | 1.44 | 1.15 | 1.40 | 1.16 | 0.33 | 0.35 | 0.44 | 0.50 | ○ | X | ○ | Δ | ○ |
| 10 | 1.41 | 1.13 | 1.39 | 1.12 | 0.40 | 0.39 | 0.39 | 0.44 | ○ | ○ | ○ | X | Δ |
| 11 | 1.49 | 1.16 | 1.48 | 1.17 | 1.58 | 1.55 | 2.12 | 2.35 | ○ | X | ○ | ○ | ○ |
| 12 | 1.39 | 1.13 | 1.38 | 1.12 | 0.33 | 0.33 | 0.40 | 0.39 | Δ | ○ | Δ | Δ | X |
| 13 | 1.41 | 1.15 | 1.41 | 1.15 | 0.40 | 0.45 | 0.41 | 0.46 | ○ | X | ○ | Δ | ○ |
| 14 | 1.31 | 1.03 | 1.29 | 0.98 | 0.40 | 0.42 | 0.42 | 0.44 | X | ○ | X | X | ○ |
| 15 | 1.30 | 1.00 | 1.26 | 0.99 | 0.42 | 0.44 | 0.48 | 0.51 | X | ○ | X | X | ○ |
| 16 | 1.40 | 1.13 | 1.40 | 1.13 | 1.72 | 1.49 | 1.92 | 1.45 | ○ | X | ○ | X | ○ |
| 17 | 1.20 | 0.90 | 1.10 | 0.80 | 0.33 | 0.41 | 0.32 | 0.35 | Δ | ○ | Δ | Δ | ○ |
| 18 | 1.50 | 1.35 | 1.45 | 1.35 | 1.81 | 1.35 | 2.00 | 1.45 | ○ | ○ | ○ | ○ | ○ |
| 19 | 1.41 | 1.15 | 1.39 | 1.15 | 0.32 | 0.40 | 0.31 | 0.44 | ○ | ○ | ○ | X | ○ |
| 20 | 1.44 | 1.19 | 1.35 | 1.14 | 0.28 | 0.51 | 0.28 | 0.34 | X | ○ | Δ | ○ | Δ |
| 21 | 1.45 | 1.13 | 1.36 | 1.13 | 0.33 | 0.39 | 0.41 | 0.29 | X | ○ | ○ | X | ○ |

Evaluation
○: good
Δ: normal
X: bad

The resulting copies were stable in image density from the initial copy up to 100 K, and good image quality could be maintained, without fogging and free of filming over the photoreceptor surface. This result is shown in Table 2.

Table 2 shows the evaluation results of the toners obtained in examples 2 through 21 shown hereinbelow in order to compare these toners with that obtained in example 1. Here, N mode and P mode mean the normal and photographic modes, respectively, and are made different, for example, by changing the voltage to be applied when the photoreceptor is charged. For example, when a scorotron type charger is used to uniformly charge the photoreceptor, −650 V is Other than above, the anti-filming performance and the anti-setoff performance were allowable. This maybe because a pertinent amount of the wax was dispersed and encapsulated in the binder.

(EXAMPLE 3)

The binder resin and coloring agent prescribed in 'example 3' in Table 1 and the charge control agent were blended under the same conditions as in example 1 to prepare a mixture of starting materials for a toner. This example 3 was carried out under the same conditions as in example 1, except that a different type of carbon black (MA-100S: a product of MITSUBISHI CHEMICAL CORPORATION) was used as the coloring agent. This carbon black is one where the surface is not oxidation treated and which presents a pH of 3.5, which is smaller than the pH (=9.0) of Printex 70 from Degussa Corporation used in example 1. A toner for electrophotography was prepared using this carbon black under the same production conditions as in example 1.

A 100 K copy run was achieved using this toner for electrophotography in a similar copier to that of example 1. The evaluation result is shown in Table 2. The evaluation result of this toner obtained in example 3 exhibited an allowable level of image density but a high level of fogging because the static charge was low as a whole. Also in this example 3, the anti-setoff performance and the anti-filming performance were satisfactory as in example 1. This can be attributed to the same reasons described in example 2.

(EXAMPLE 4)

The binder resin and coloring agent prescribed in 'example 4' in Table 1 and the charge control agent were blended under the same conditions as in example 1 to prepare a mixture of starting materials for a toner. In this example 4, a toner for electrophotography was prepared in the same manner and under the same conditions as in example 1, except that the HpMn of the high polymer component of the binder resin was $0.8\times10^5$ and the LpMn of the low molecular weight component was $1.5\times10^3$.

A 100 K copy run was achieved using this toner for electrophotography in a similar copier to that of example 1. The evaluation result is shown in Table 2. The evaluation result of this toner obtained in example 4 exhibited image density and fogging which were of an allowable level, but the anti-filming performance, the anti-aging performance and the anti-setoff performance were poor.

These problems attributed to the setting of the molecular weight of the binder resin, hence these drawbacks can be eliminated by setting the molecular weight in the range specified in example 1.

(EXAMPLE 5)

The binder resin and coloring agent prescribed in 'example 5' in Table 1 and the charge control agent were blended under the same conditions as in example 1 to prepare a mixture of starting materials for a toner. In this example 5, a toner for electrophotography was prepared in the same manner and under the same conditions as in example 1, except that the HpMn of the high polymer component of the binder resin was $3.0\times10^5$ and the LpMn of the low molecular weight component was $3.5\times10^3$.

A 100 K copy run was achieved using this toner for electrophotography in a similar copier to that of example 1. The evaluation result is shown in Table 2. The evaluation result of this toner obtained in example 5 exhibited image density and fogging which were of an allowable level and showed some improvement as to the problems of the anti-filming performance and the anti-setoff performance of example 4, but an inferiority in fixing performance.

(EXAMPLE 6)

The binder resin and coloring agent prescribed in 'example 6' in Table 1 and the charge control agent were blended under the same conditions as in example 1 to prepare a mixture of starting materials for a toner. In this example 6, a toner for electrophotography was prepared in the same manner and under the same conditions as in example 1, except that the preservation elasticity G (represented in terms of a temperature when the modulus of elasticity is equal to 1 ($N/cm^2$)) of the resin as the binder resin was 150° C.

A 100 K copy run was achieved using this toner for electrophotography in a similar copier to that of example 1. The evaluation result is shown in Table 2. The evaluation result of this toner obtained in example 6 exhibited image density and fogging which were of an allowable level, but showed poor anti-filming performance, anti-aging performance and anti-setoff performance.

(EXAMPLE 7)

The binder resin and coloring agent prescribed in 'example 7' in Table 1 and the charge control agent were blended under the same conditions as in example 1 to prepare a mixture of starting materials for a toner. In this example 7, a toner for electrophotography was prepared in the same manner and under the same conditions as in example 1, except that the preservation elasticity G (represented in terms of a temperature when the modulus of elasticity is equal to 1 ($N/cm^2$)) of the resin as the binder resin was 220° C.

A 100 K copy run was achieved using this toner for electrophotography in a similar copier to that of example 1. The evaluation result is shown in Table 2. The evaluation result of this toner obtained in example 7 exhibited image density and fogging which were of an allowable level, and showed elimination of the problems of example 6, but showed an inferiority in fixing performance.

(EXAMPLE 8)

The binder resin and coloring agent prescribed in 'example 8' in Table 1 and the charge control agent were blended under the same conditions as in example 1 to prepare a mixture of starting materials for a toner. In this example 8, a toner for electrophotography was prepared in the same manner and under the same conditions as in example 1, except that the melt viscosity $T\eta$ (the temperature at which the complex module of viscosity $|\eta^*|$ becomes equal to 1000 Pa·s) of the resin as the binder resin was 110° C.

A 100 K copy run was achieved using this toner for electrophotography in a similar copier to that of example 1. The evaluation result is shown in Table 2. The evaluation result of this toner obtained in example 8 exhibited image density and fogging which were of an allowable level, but showed a poor anti-setoff performance.

(EXAMPLE 9)

The binder resin and coloring agent prescribed in 'example 9' in Table 1 and the charge control agent were blended under the same conditions as in example 1 to prepare a mixture of starting materials for a toner. In this example 9, a toner for electrophotography was prepared in the same manner and under the same conditions as in example 1, except that the melt viscosity $T\eta$ (the temperature at which the complex module of viscosity $|\eta^*|$ becomes equal to 1000 Pa·s) of the resin as the binder resin was 140° C.

A 100 K copy run was achieved using this toner for electrophotography in a similar copier to that of example 1. The evaluation result is shown in Table 2. The evaluation result of this toner obtained in example 9 exhibited image density and fogging which were of an allowable level, and showed elimination of the problem of example 8, but showed an inferiority in fixing performance.

(EXAMPLE 10)

The binder resin and coloring agent prescribed in 'example 10' in Table 1 and the charge control agent were blended under the same conditions as in example 1 to prepare a mixture of starting materials for a toner. In this example 10, a toner for electrophotography was prepared in the same manner and under the same conditions as in example 1, except that the loss elasticity G' of the resin as the binder resin was 3.0 ($N/cm^2$) at 140° C.

A 100 K copy run was achieved using this toner for electrophotography in a similar copier to that of example 1. The evaluation result is shown in Table 2. The evaluation result of this toner obtained in example 10 exhibited image density and fogging which were of an allowable level, but showed a poor anti-setoff performance.

(EXAMPLE 11)

The binder resin and coloring agent prescribed in 'example 11' in Table 1 and the charge control agent were blended under the same conditions as in example 1 to prepare a mixture of starting materials for a toner. In this example 11, a toner for electrophotography was prepared in the same manner and under the same conditions as in example 1, except that the loss elasticity G' of the resin as the binder resin was 5.0 ($N/cm^2$) at 140° C.

A 100 K copy run was achieved using this toner for electrophotography in a similar copier to that of example 1. The evaluation result is shown in Table 2. The evaluation result of this toner obtained in example 11 produced an image having an allowable level of image density but a high level of fogging because the static charge distribution had a wide spread containing many toner particles having the opposite polarity. The problem of the anti-setoff performance in example 10 could be eliminated but the fixing performance was degraded significantly.

(EXAMPLE 12)

The binder resin and coloring agent prescribed in 'example 12' in Table 1 and the charge control agent were blended under the same conditions as in example 1 to prepare a mixture of starting materials for a toner. In this example 12, a toner for electrophotography was prepared in the same manner and under the same conditions as in example 1, except that the glass-transition temperature (° C.) of the binder resin was at 55° C.

A 100 K copy run was achieved using this toner for electrophotography in a similar copier to that of example 1. The evaluation result is shown in Table 2. The evaluation result of this toner obtained in example 12 exhibited image density and fogging which were of an allowable level, but showed a poor preservability.

(EXAMPLE 13)

The binder resin and coloring agent prescribed in 'example 13' in Table 1 and the charge control agent were blended under the same conditions as in example 1 to prepare a mixture of starting materials for a toner. In this example 13, a toner for electrophotography was prepared in the same manner and under the same conditions as in example 1, except that the glass-transition temperature (° C.) of the binder resin was at 75° C.

A 100 K copy run was achieved using this toner for electrophotography in a similar copier to that of example 1. The evaluation result is shown in Table 2. The evaluation result of this toner obtained in example 13 exhibited image density and fogging which were of an allowable level, and elimination of the preservability problem in example 12, but showed a poor fixing performance.

(EXAMPLE 14)

The binder resin and coloring agent prescribed in 'example 14' in Table 1 and the charge control agent were blended under the same conditions as in example 1 to prepare a mixture of starting materials for a toner. In this example 14, a toner for electrophotography was prepared under the same conditions as in example 1, except that a different type of carbon black (Printex 95: a product of Degussa Corporation) was used as the coloring agent. This carbon black has a DBP oil absorption of 52 (ml/100 g).

A 100 K copy run was achieved using this toner for electrophotography in a similar copier to that of example 1. The evaluation result is shown in Table 2. The evaluation result of this toner obtained in example 14 exhibited a low image density from the initial stage, and no signs of recovery. Fogging was not so bad, but filming arose over the photoreceptor and the anti-aging performance and anti-setoff performance became poor after a 100 K run.

(EXAMPLE 15)

The binder resin and coloring agent prescribed in 'example 15' in Table 1 and the charge control agent were blended under the same conditions as in example 1 to prepare a mixture of starting materials for a toner. In this example 15, a toner for electrophotography was prepared under the same conditions as in example 1, except that a different type of carbon black (Printex A: a product of Degussa Corporation) was used as the coloring agent. This carbon black has a primary particle diameter of 41 (nm) and contains a low volatile component (0.7%).

A 100 K copy run was achieved using this toner for electrophotography in a similar copier to that of example 1. The evaluation result is shown in Table 2. The evaluation result of this toner obtained in example 15 exhibited a low image density from the initial stage, and no signs of recovery. Fogging was not so bad, but filming arose over the photoreceptor and the anti-aging performance and anti-setoff performance became poor after a 100 K run.

(EXAMPLE 16)

The binder resin and coloring agent prescribed in 'example 16' in Table 1 and the charge control agent were blended under the same conditions as in example 1 to prepare a mixture of starting materials for a toner. In this example 16, a toner for electrophotography was prepared under the same conditions and using the same materials as in example 1, except that a different type of carbon black (OIL31B: a product of MITSUBISHI CHEMICAL CORPORATION) was used as the coloring agent. This carbon black contains a very high volatile component (5.5%), and has a relatively large DBP oil absorption of 107 (ml/100 g) and a relatively large primary particle diameter of 30 (nm).

A 100 K copy run was achieved using this toner for electrophotography in a similar copier to that of example 1. The evaluation result is shown in Table 2. The evaluation result of this toner obtained in example 16 exhibited a retention of image density but showed a reduced static charge and hence produced a foggy image. The anti-setoff performance and the fixing performance were degraded.

(EXAMPLE 17)

The binder resin and coloring agent prescribed in 'example 17' in Table 1 and the charge control agent were blended under the same conditions as in example 1 to prepare a mixture of starting materials for a toner. In this example 17, a toner for electrophotography was prepared under the same conditions as in example 1, except that the added amount of carbon black as the coloring agent was changed to 3 parts by weight.

A 100 K copy run was achieved using this toner for electrophotography in a similar copier to that of example 1. The evaluation result is shown in Table 2. The evaluation result of this toner obtained in example 17 showed that the toner was low in hiding power, and tended to bear a high amount of static charge, hence produced a low image density. Further, the anti-filming performance and the anti-aging performance were poor and the anti-setoff performance was somewhat lacking.

(EXAMPLE 18)

The binder resin and coloring agent prescribed in 'example 18' in Table 1 and the charge control agent were blended under the same conditions as in example 1 to prepare a mixture of starting materials for a toner. In this example 18, a toner for electrophotography was prepared under the same conditions as in example 1, except that the added amount of carbon black as the coloring agent was changed to 13 parts by weight.

A 100 K copy run was achieved using this toner for electrophotography in a similar copier to that of example 1. The evaluation result is shown in Table 2. The evaluation result of this toner obtained in example 18 exhibited normal image density, but showed an insufficiency in the amount of static charge and hence produced a foggy image. However, the anti-filming performance, the anti-aging performance, the anti-setoff performance, the fixing performance and the preservability were all excellent.

(EXAMPLE 19)

The binder resin and coloring agent prescribed in 'example 19' in Table 1 and the charge control agent were blended under the same conditions as in example 1 to prepare a mixture of starting materials for a toner. In this example 19, a toner for electrophotography was prepared in the same manner and under the same conditions as in example 1, except that the content of the wax encapsulated within the binder resin was '0' that is, the binder contained no wax.

A 100 K copy run was achieved using this toner for electrophotography in a similar copier to that of example 1. The evaluation result is shown in Table 2. The evaluation result of this toner obtained in example 19 exhibited image density and fogging which were of an allowable level, but showed a poor anti-setoff performance.

(EXAMPLE 20)

The binder resin and coloring agent prescribed in 'example 20' in Table 1 and the charge control agent were blended under the same conditions as in example 1 to prepare a mixture of starting materials for a toner. In this example 20, a toner for electrophotography was prepared in the same manner and under the same conditions as in example 1, except that the content of the wax encapsulated within the binder resin was 6.0 parts by weight.

A 100 K copy run was achieved using this toner for electrophotography in a similar copier to that of example 1. The evaluation result is shown in Table 2. The evaluation result of this toner obtained in example 20 exhibited image density and fogging which were of an allowable level, and showed improvement as to the anti-setoff of example 19 but inferiority in anti-filming performance and anti-aging performance.

(EXAMPLE 21)

The binder resin and coloring agent prescribed in 'example 21' in Table 1 and the charge control agent were blended under the same conditions as in example 1 to prepare a mixture of starting materials for a toner. In this example 21, a toner for electrophotography was prepared in the same manner and under the same conditions as in example 1, except that the domain diameter of the wax encapsulated in the binder resin was 1.0 $\mu$m.

A 100 K copy run was achieved using this toner for electrophotography in a similar copier to that of example 1. The evaluation result is shown in Table 2. The evaluation result of this toner obtained in example 21 exhibited image density and fogging which were of an allowable level, but showed poor anti-filming performance and anti-setoff performance.

As seen from the above diverse examples, on the basis of the evaluation results in Tables 1 and 2, the toner which is excellent in image density, fogging, anti-filming performance, anti-aging performance, anti-setoff performance, fixing performance and preservability is concluded to be that of example 1. From the comparison between the toner of example 1 and that of example 2, it can be understood that the toner is good when the binder resin used has an acid value of 0.3 (mgKOH/g) while the toner produces fogging when the binder resin used has an acid value of 3.0 (mgKOH/g). This means that selection of a binder resin having a small acid value produces a good result. Thus, binder resins of which the acid value is small produce a good result, so that the acid value is adjusted to being smaller than 3.0 (mgKOH/g) and is preferably set equal to 1.0 (mgKOH/g) or below. More preferably, if the acid value is set equal to 0.5 (mgKOH/g) as shown in example 1, this produces a good result. In conclusion, selection of a binder resin having an acid value of lower than 1.0 (mgKOH/g) will produce the best result.

From the comparison between the toner of example 1 and that of example 3, it can be understood that different types of carbon black as the coloring agent produce different results, that is, the toner of example 1 could produce an image having beneficial image density free from fogging while the toner of example 3 exhibited an image having much fogging. This difference largely depends on the pH value when the surface is not oxidation treated. Specifically, the pH value is 9.0 in example 1 while it is as small as 3.5 in example 3. Therefore, carbon black as the coloring agent needs to have a pH of more than 3.5, at least exceeding 5.0. Preferably, a coloring agent having a pH of 7.0 or more is desired.

In general, while binder resins, coloring agents, e.g., carbon black, have acid functional groups such as COOH, OH, CO, etc., on the surface thereof, and they present a stronger tendency toward being positively charged as the number of such functional groups lowers. One of the indicators of the amount of functional groups on a binder resin or carbon black is the acid value or the pH value. As the acidity value lowers, the acid value of a resin becomes smaller, while the pH value of carbon black becomes greater.

When all these main components in the toner are adapted to have the same polarity, it is possible to suppress static charge irregularities of individual toner particles. In general, the static charge characteristic of the toner depends on the charge control agent (CCA) as the most dominant charge carrier in the toner. When the polarity of the binder resin, carbon black and other components differs from that of the CCA, these minor charge will be offset by the charge of the most dominant carrier, and the toner will have an opposite polarity charge distribution on the surface thereof. On the contrary, when the polarities of the binder resin and carbon black are the same as that of the charge control agent (CCA), it is possible to eliminate the above drawbacks and hence provide a toner in which the toner particles as a whole are uniform as to static charge presenting a sharp static charge distribution.

Thus, the coloring agent, the binder resin and the charge control agent for determining the polarity of static charge are selected, so that the combination between the acid value of the binder resin and the pH value of the coloring agent is optimized, thus making it possible to stabilize the static charge characteristic of the toner providing a toner having a sharp (narrow) charge amount distribution. The toner shown in example 1, in particular, is of positive polarity.

In the present invention, with regard to the number average molecular weight Mn of the binder resin as the main component of the toner for electrophotography, it is understood from the comparison of example 1 with examples 4 and 5, when the number average molecular weight Mn of the high polymer component was $1.75\times10^5$ a good result could be obtained whereas the result was problematical if the number average molecular weight Mn was $0.8\times10^5$ as in example 4 and was $3.0\times10^5$ as in example 5. Therefore, a good result is obtained around the value of example 1, so that the number average molecular weight Mn should be set within the range between examples 4 and 5. Thus, a good result can be obtained if the number average molecular weight Mn of the high polymer component of the binder resin is set within the range from $1.0\times10^5$ to $2.5\times10^5$.

As to the number average molecular weight Mn of the binder resin of the lower molecular weight component, if it falls within the range of $2.0\times10^3$ to $3.2\times10^3$, a good result can be obtained.

The specifications of the binder resin required for a toner for electrophotography depend on the copy speed (developing speed). That is, the higher the copy speed is, the higher the durability needs to be. For this purpose, the molecular weight of the binder resin and the ratio between the high polymer component and the low molecular component should be optimized so as to deal with a high speed configuration which, for example, prints more than 70 sheets per minute. In this case, although, in particular, filming and setoff performances show problems, a further good result can be obtained when the amount of wax contained in the toner together with the binder resin is considered.

It is understood from the comparison of example 1 with examples 6 and 7, a good result can be obtained if the preservation elasticity of the binder resin, represented in terms of a temperature when the modulus of elasticity is equal to 1 ($N/cm^2$) is around 186° C. From examples 6 and 7, if the preservation elasticity of the binder resin is not higher than 150° C., the anti-filming and the anti-setoff performances degrade, whereas if it is 220° C. or above, the fixing performance degrades while the anti-filming performance and the setoff performance are improved. Therefore, if the preservation elasticity of the binder resin is set within a range of at least 180° C. but not higher than 200° C., a good result can be obtained.

To sum up, the viscoelasticity of the binder resin strongly correlate with the fixing, anti-setoff and material dispersion performances of the toner. In a case of a high polymer resin for a high speed operation, the fixing, anti-setoff and material dispersion performances tend to lower. In this respect, it is possible to modify the resin for a high speed operation so as to have beneficial fixing, anti-setoff and material dispersion performances, by optimizing the viscoelastic properties. Again, as stated above, the temperature at which the preservation elasticity is equal to 1 ($N/cm^2$) strongly correlates with the anti-setoff performance. Actually, as the temperature becomes higher, the temperature at which a high temperature setoff arises becomes higher, but then again the fixing performance degrades. Therefore, it is possible to keep the anti-setoff performance and the fixing performance good when the preservation elasticity is set within the above range.

Comparing example 1 with examples 8 and 9, it is found that a good result can be obtained when the melt viscosity $T\eta$ (the temperature at which the complex module of viscosity $|\eta^*|$ becomes equal to 1000 Pa.s) of the binder resin is around 122° C., and the anti-setoff performance degrades when the melt viscosity is 110° C. or below and the fixing performance degrades when the melt viscosity is 140° C. or above. Therefore, a good result can be obtained when the melt viscosity $T\eta$ of the binder resin is set within the range of 120° C. to 130° C.

This is owing to the fact that the melt viscosity $T\eta$ (the temperature at which the complex module of viscosity $|\eta^*|$ becomes equal to 1000 Pa.s) strongly correlates with the fixing performance. Actually, if the melt viscosity $T\eta$ is low, a better fixing performance can be obtained while the anti-setoff performance is lowered. On the contrary, if the melt viscosity $T\eta$ is high, the fixing performance degrades while the anti-setoff performance tends to be improved. Thus, in the present invention, it is possible to fulfill satisfactory levels of the anti-setoff performance and the fixing performance when the melt viscosity $T\eta$ is set within the above range.

Comparing example 1 with examples 10 and 11, it is found that a good result can be obtained when the loss elasticity of the binder resin at 140° C. is around 3.8 $N/cm^2$, and the anti-setoff performance degrades when the loss elasticity is 3.0 ($N/cm^2$) or below while the fixing performance degrades when the loss elasticity is 5.0 ($N/cm^2$) or above. Therefore, a good result inclusive of the setoff performance and the fixing performance can be obtained when the loss elasticity of the binder resin is set within the range of 3.4 ($N/cm^2$) to 4.5 ($N/cm^2$).

This loss elasticity at 140° C. strongly correlates with the fixing performance, anti-setoff performance and the material dispersion performance. If the loss elasticity is low, good fixing and material dispersion performances can be obtained while the anti-setoff performance degrades. If the loss elasticity is high, the fixing performance degraded but the anti-setoff and material dispersion performances tend to be improved. Thus, it is possible to keep the material dispersion performance good as well as the anti-setoff performance and the fixing performance when the loss elasticity is set within the above range. Therefore, the dispersion performance of the wax contained within the binder resin can also be improved.

Comparing example 1 with examples 12 and 13, it is found from example 1 that a good result can be obtained when the glass-transition temperature Tg of the binder resin is around 65° C. If it is 55° C. or below the preservability is found to be problematic from the result of example 12 while from the result of example 13 if it is 75° C. or above, the fixing performance becomes problematic due to fusion or other problems. Accordingly, setting the glass-transition temperature Tg of the binder resin within the range of 60° C. to 75° C., makes it possible to solve the problems of preservability and fixing performance.

As a matter of fact, the glass-transition temperature Tg strongly correlates with the preservability of the toner. Accordingly, if this value is small, the preservability is bad. On the other hand, if this value is large, the problem of fixing performance arises while the preservability is good. Therefore, it is possible to secure high enough preservability and fixing performance by setting the glass-transition temperature Tg within the aforementioned range.

Apart from the binder resin described heretofore, other materials constituting a toner, namely, carbon black as the coloring agent in the present invention, will also produce various problems. Therefore, specifying the properties of carbon black is effective in obtaining a more beneficial result.

For this purpose, example 1 is compared with examples 14 through 16. From this comparison, it is found that unless the DBP oil absorption, the primary particle size and the volatile component are set within their appropriate ranges, the anti-filming performance, the anti-aging performance and the anti-setoff performance etc., show problems.

For example, it is understood from example 14 that when the DBP oil absorption is as low as 52 (ml/100 g), the fixing performance and the anti-setoff performance show bad results. This can be explained as follows. Typically, carbon black takes the form of a string-like structure of primary particles and such structures are dispersed in the toner. The dimensions of this structure strongly correlate with the degree of blackness, fixing performance and anti-setoff performance of the toner itself. In general, it is known that the shorter the structure, the better the above performances tend to be. The DBP oil absorption is one of the indices representing the dimensions of the structure. That is, it is known that the greater the oil absorption, the smaller the structure. Therefore, it is possible to obtain a toner excellent in degree of blackness, fixing performance and anti-setoff performance by specifying the DBP oil absorption. From the result of example 14 etc., it is important to set the DBP oil absorption greater than 52 (ml/100 g) and preferably at least 90 (ml/100 g) or more.

When the primary particle size is as large as 41 (nm) as in example 15, the anti-setoff performance and fixing performance are poor. This is because the primary particle size of the carbon black strongly correlates with the toner viscoelasticity and the degree of blackness. That is, it is known that the smaller the primary particle size of carbon black, the better the viscoelasticity and the degree of blackness tend to be. Therefore, by selecting a type of carbon black, as the coloring agent, having a smaller primary particle size than 41 (nm) as in example 15, it is possible to improve the degree of blackness of the toner, the fixing performance represented by the viscoelasticity and the anti-setoff performance. In this case, also taking into consideration the result of example 1, setting of the primary particle diameter of this coloring agent smaller than 30 (nm) makes it possible to produce a good result.

Further, the carbon black used in example 16 is very high in its volatile component (5.5%). This degrades the charge performance and the fixing performance and anti-setoff performance. As compared with this, the amount of the volatile component in example 1 is very small, specifically 1.2%. Therefore, the fixing performance can be improved when the volatile component of carbon black as the coloring agent is limited to less than 2.0%.

Carbon black as the coloring agent contains a variety of impurities, which are generally known to have a strong negative charge characteristic and to obstruct the improvement of the elasticity of the resin. Further, the more of these impurities the carbon black contains, the more the volatile component. Therefore, limitation of the volatile component of the coloring agent as above, makes it possible to produce a toner excellent in its charge characteristics and improves the elasticity of the binder resin and hence improves the fixing and anti-setoff performances etc., of the toner.

Carbon black has a high hiding power. On the other hand, it also presents a high conductivity. Therefore, addition of only a small amount of carbon black produces an insufficiency in degree of blackness, and gives a high resistance and hence produces a high static charge, degrading the hiding power. In contrast, addition of a large amount of carbon black increases the hiding power, but lowers the resistance and hence causes toner scatter and fogging.

For this reason, the carbon black content shown in examples 17 and 18 are not pertinent. Therefore, carbon black should be added four parts by weight to 15 parts by weight in order to achieve a beneficial degree of blackness as well as improved fixing and anti-setoff performances. This limitation provides a good result.

The amount of the wax to be encapsulated within the binder resin is determined, and becomes apparent by, comparing the results of examples 19 and 20 with that of example 1. When no wax is encapsulated, the anti-setoff performance is poor. When plenty of wax is added, the anti-filming performance becomes problematical. Therefore, the encapsulated amount of the wax should be at least 1.0 parts by weight from the result of example 21, and should be at most 6.0 part by weight, preferably 5.0 parts by weight or below, in order to achieve improved anti-filming and anti-setoff performances.

In this way, the wax is dispersed uniformly in the toner and the added amount has a significant influence on the anti-setoff performance and the anti-filming performance. Therefore, it is possible to improve the anti-setoff performance and the anti-filming performance by limiting the added amount of the wax as above. In particular, in the case where the wax has been encapsulated within the binder resin, if the dispersed state is made uniform, it is possible to uniformly disperse it in the toner by fusing and kneading during toner manufacturing. Further, when the encapsulated amount is set within the aforementioned range, it is possible to produce a further improved result.

Thus, the wax, especially the added amount and dispersion state, largely affects the anti-filming performance and the anti-setoff performance. The domain diameter of the wax also has an influence on the dispersion performance.

Therefore, from the comparison between example 1 and example 21, the anti-filming performance and the anti-setoff performance showed problems in example 21 where the domain diameter of the wax encapsulated in the binder resin was 1.0 $\mu$m, while the problems could be eliminated in example 1 where the domain diameter was 0.3 $\mu$m. Resultantly, the domain diameter should be set smaller than, at least, 1.0 μm. This condition is for the diameter of the wax when it has been dispersed and encapsulated in the binder resin. It is more preferable, if the encapsulated diameter of the wax is set 0.5 μm or lower.

In general, a styrene acrylic binder resin is a high polymeric, high elastic resin. If this resin is used as the binder resin to prepare a toner using a wax, it is very difficult to control the domain diameter of the wax. Therefore, optimization of the domain diameter of the wax in the finished toner required regulation of the diameter beforehand, and uniform dispersion and encapsulation within the binder resin. Thus, a beneficent result was obtained.

In particular, to optimize the domain diameter of the wax within the binder resin, it was found that the encapsulation using a solution polymerization method was markedly useful. The use of a binder resin in which the wax was encapsulated by the solution polymerization provided improvement in anti-setoff performance and anti-filming performance as stated above.

All the examples described heretofore are of a two component developer in which the toner is mixed with carriers. However, the toner of the present invention can of course be used as a developer of a single component toner (externally additive-treated one). When a single component toner is used as a magnetic toner, it can be easily obtained by adding a magnetic substance, in addition to the coloring agent, charge control agent and the like, into the binder resin. The thus obtained single component magnetic toner can sufficiently present the advantages described with reference to the above examples, and prevent variations in image density and increase in fogging and the occurrence of filming phenomenon, etc. At the same time it is possible to obtain an beneficial toner which is excellent in fixing performance and free from the setoff phenomenon.

In accordance with the toner for electrophotography of the present invention, it is possible to prevent the setoff phenomenon during the fixing process and at the same time, it is possible to beneficially prevent the filming phenomenon, that is, the adherence of the toner to the photoreceptor which would have occurred when the prevention of the setoff phenomenon was enhanced.

It is also possible to provide a toner which presents markedly stable charge performance with a sharp charge distribution and will neither cause large variations in image density nor increase in fogging, and is also excellent in fixing performance.

In particular, the DBP oil absorption of the coloring agent contained in the toner, the primary particle size and the volatile component may be set within the appropriate specified ranges, it is possible to provide a toner for electrophotography excellent in static charge performance as stated above. As a result, it is possible to provide a toner which can present stabilized image quality, keep the viscoelasticity of the binder resin in a good condition and hence overcome the problem of the setoff phenomenon as well as eliminating the filming phenomenon.

What is claimed is:

1. A toner for electrophotography, comprising: a binder resin as the main component, a coloring agent and a charge control agent, wherein an acid value of the binder resin is 1.0 (mgKOH/g) or below, and the coloring agent has a non-oxidized surface having a pH of 7.0 or higher.

2. The toner for electrophotography according to claim 1, wherein a low molecular weight polypropylene wax is encapsulated in the binder resin and the low molecular weight polypropylene wax is included 0.5 part to 5 parts by weight of wax for 100 parts by weight of the binder resin.

3. The toner for electrophotography according to claim 1, wherein a number average molecular weight (Mn) of a high polymer component of the binder resin falls within a range of $1.0\times10^5 \leqq Mn \leqq 2.5\times10^5$, and a number average molecular weight Mn of a low molecular weight component of the binder resin falls within a raange of $2.0\times10^3 \leqq Mn \leqq 3.2\times10^3$.

4. The toner for electrophotography according to claim 1, wherein a DBP oil absorption of the coloring agent is 90 (ml/100 g) or more.

5. The toner for electrophotography according to claim 1, wherein a primary particle diameter of the coloring agent is smaller than 30 (nm).

6. The toner for electrophotography according to claim 1, wherein a volatile component of the coloring agent is 2.0(%) or less.

* * * * *